US006726257B2

(12) United States Patent
Horgan, Jr.

(10) Patent No.: US 6,726,257 B2
(45) Date of Patent: Apr. 27, 2004

(54) PANIC HANDLE FOR DOORS

(75) Inventor: William J. Horgan, Jr., New Smyrna Beach, FL (US)

(73) Assignee: Blumcraft of Pittsburgh, Pittsburgh, PA (US)

( * ) Notice: Subject to any disclaimer, the term of this patent is extended or adjusted under 35 U.S.C. 154(b) by 0 days.

(21) Appl. No.: 10/288,342

(22) Filed: Nov. 5, 2002

(65) Prior Publication Data

US 2003/0062725 A1 Apr. 3, 2003

Related U.S. Application Data

(62) Division of application No. 09/469,813, filed on Dec. 22, 1999, now Pat. No. 6,511,104.

(51) Int. Cl.[7] ..... E05B 3/00
(52) U.S. Cl. ..... 292/336.3; 292/93
(58) Field of Search ..... 292/92, 93, 336.3, 292/DIG. 65; 70/93

(56) References Cited

U.S. PATENT DOCUMENTS

| | | | | |
|---|---|---|---|---|
| 1,386,551 A | | 8/1921 | Bumbarger | |
| 1,441,336 A | | 1/1923 | Flowers | |
| 2,261,652 A | | 11/1941 | La Mere | |
| 2,992,846 A | | 7/1961 | Schwantz et al. | |
| 3,024,053 A | * | 3/1962 | Cox | 392/21 |
| 3,696,648 A | | 10/1972 | Horgan, Jr. | |
| D226,365 S | | 2/1973 | Horgan, Jr. | |
| D228,734 S | | 10/1973 | Horgan, Jr. | |
| 3,765,198 A | | 10/1973 | Horgan, Jr. | |
| 3,854,763 A | | 12/1974 | Zawadzki et al. | |
| 4,366,974 A | | 1/1983 | Horgan, Jr. | |
| 4,382,620 A | | 5/1983 | Horgan, Jr. | |
| 4,418,949 A | | 12/1983 | Horgan, Jr. | |
| 4,506,922 A | | 3/1985 | Horgan, Jr. | |
| 4,711,480 A | | 12/1987 | Horgan, Jr. | |
| 4,895,399 A | | 1/1990 | Horgan, Jr. | |
| 5,547,235 A | * | 8/1996 | Dziuk et al. | 292/92 |
| 5,615,918 A | * | 4/1997 | Ferrell | 292/92 |
| 6,145,897 A | | 11/2000 | Locher | |
| 6,189,939 B1 | * | 2/2001 | Zehrung | 292/92 |
| 6,511,104 B1 | | 1/2003 | Horgan, Jr. | |

OTHER PUBLICATIONS

U.S. patent application Ser. No. 09/469,813 Filed Dec. 22, 1999, Horgan, Jr.

* cited by examiner

*Primary Examiner*—Gary Estremsky
(74) *Attorney, Agent, or Firm*—Paul & Paul

(57) ABSTRACT

A handle assembly is adapted for a panic handle having a latching mechanism. The handle assembly includes a handle that is moveable between extended and retracted positions and a slide moveable laterally corresponding to movements of the handle. The movement of the handle between the extended and retracted positions works to operate the latching mechanism.

22 Claims, 12 Drawing Sheets

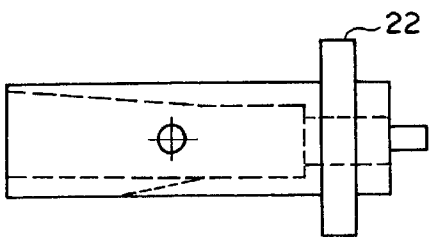
FIG. 18a
FIG. 18b
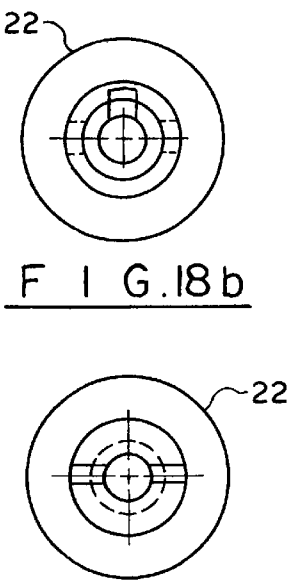
FIG. 18c
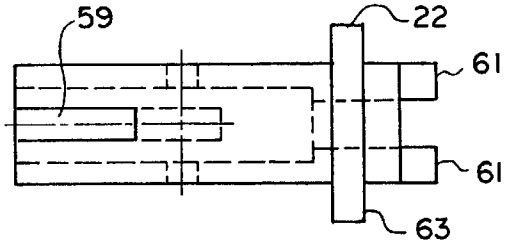
FIG. 18d
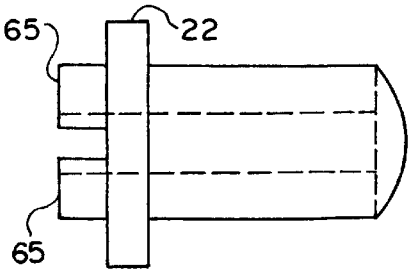
FIG. 19a
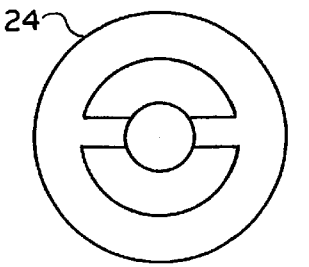
FIG. 19b
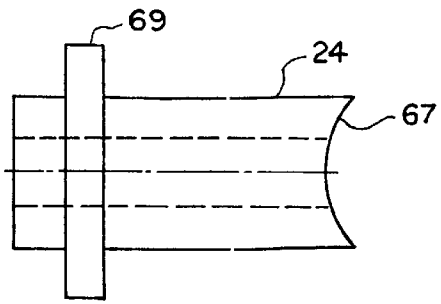
FIG. 19c

PANIC HANDLE FOR DOORS

CROSS-REFERENCE TO RELATED APPLICATIONS

This application is a divisional of U.S. Application for Patent Ser. No. 09/469,813, filed on Dec. 22, 1999 now U.S. Pat. No. 6,511,104.

BACKGROUND OF THE INVENTION

1. Field of the Invention

The present invention relates generally to doors handles and to latch assemblies for securing doors and the like in a closed position, and more specifically, the present invention is directed to latch actuating door handles of the panic handle type.

2. Brief Description of the Prior Art

Panic handles are generally operable to secure doors and the like in a latched position and provide unlatching by actuation of the door handle. A primary benefit of panic handles are that they provide unlatching of the door in a quick and simple manner, and for this reason, panic handles are often utilized in applications which require ready exit from a building in case of an emergency. Some examples of panic handles are illustrated in my prior U.S. Pat. No. 4,895,399 issued Jan. 23, 1990; U.S. Pat. No. 4,711,480 issued Dec. 8, 1987; U.S. Pat. No. 4,506,922 issued Mar. 26, 1985; U.S. Pat. No. 4,418,949 issued Dec. 6, 1983; U.S. Pat. No. 4,382,620 issued May 10, 1983 and U.S. Pat. No. 4,366,974 issued Jan. 4, 1983, all assigned to Blumcraft of Pittsburgh, the assignee of the present invention, the complete disclosures of which are incorporated by reference herein. These above-referenced patents disclose panic handles comprising a bar carried by a door and having an internal latch mechanism that is activated to unlatch the door when the bar is moved from a position away from the door to a position close to the door. An advantage of these types of prior art devices is that the latch mechanism is located within the bar, which allows for use in broader applications since minimal panel preparation is required, such as with glass panels, and it also yields a more aesthetic overall appearance. Another advantage of such prior art devices is that the bar can be mounted spaced from the door, which makes the bar easier to grasp facilitating its ease of use and which also can be a particular benefit in emergency situations. The spaced mounting of the bar also works to contribute to the overall appearance of the panic handle. Still another advantage is that the bar can be provided in a number of different configurations, such as "L" shaped and straight, which further contributes to the versatility of such devices.

Other types of panic devices are known in the art that lack the properties noted with respect to the above-referenced patents. For example, U.S. Pat. No. 3,897,092 to Atkins discloses one type of panic handle comprising a latch mechanism mounted on the door and a separate bar pivotally mounted in order to operate the latch mechanism. Another type of panic handle is shown in U.S. Pat. No. 4,083,590 to Folger which comprises a latch assembly mounted on the door and a separate bar that is moved in inward and outward directions relative to the door for operating the latch assembly. Such types of devices have the additional deficiency that numerous different components are utilized, which results in a larger overall construction. In addition, the relative movement of the numerous different components in operation leave such devices susceptible to damage, which can result in complete failure of these types of panic handles.

The present invention is directed to another panic handle that has been developed in view of the prior art panic handles noted above.

SUMMARY OF THE INVENTION

The present invention is directed to a handle assembly for a panic handle and with the handle assembly including a handle movable in a direction substantially perpendicular the surface of the door between an outward position spaced from the door and an inward position closer to the door, and with the handle including an opening therein and means substantially within the opening of the handle for translating the handle between the extended and retracted positions.

BRIEF DESCRIPTION OF THE DRAWINGS

FIG. 18*a* is an isolated front elevational view of an interior spacer of the handle assembly of FIG. 7.

FIG. 18*b* is a left side elevational view of the interior spacer of FIG. 18*a*.

FIG. 18*c* is a right side elevational view of the interior spacer of FIG. 18*a*.

FIG. 18*d* is a top plan elevational view of the interior spacer of FIG. 18*a*.

FIG. 19*a* is an isolated front elevational view of an exterior spacer of the handle assembly of FIG. 7.

FIG. 19*b* is a left side elevational view of the exterior spacer of FIG. 19*a*.

FIG. 19*c* is a top plan view of the exterior spacer of FIG. 19*a*.

DETAILED DESCRIPTION OF THE PREFERRED EMBODIMENTS

Figure 1:
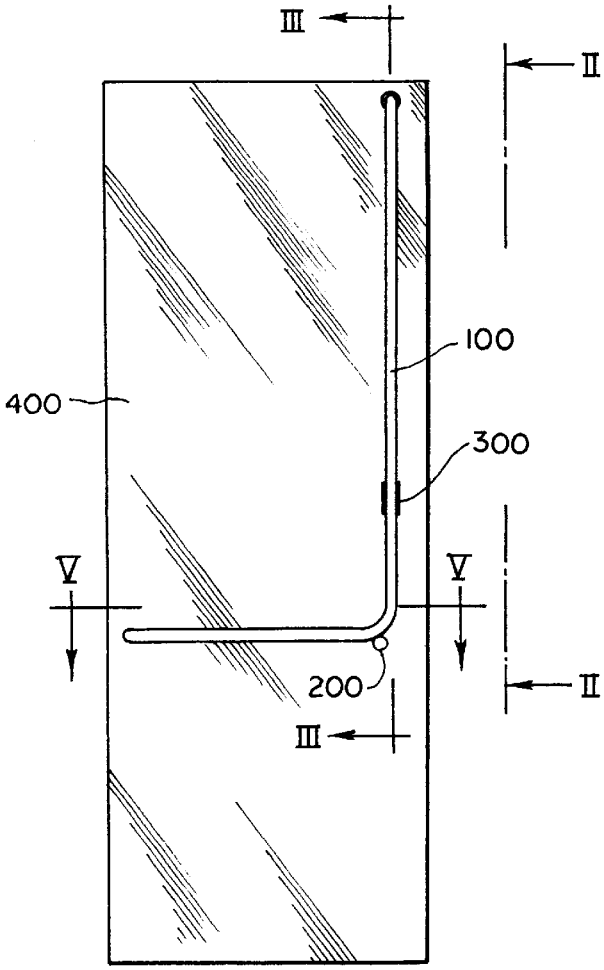
FIG. 1 (PRIOR ART)
FIG. 1 is a front elevational view of a prior art panic handle shown and described in my earlier U.S. Pat. No. 4,366,974 issued Jan. 4, 1983, with the panic handle shown installed on a rectangular door.

Referring now to the drawings in detail, wherein like reference numerals indicate like elements throughout the several views, there is illustrated two embodiments of a panel handle in accordance with the present invention. The panic handles of the illustrated embodiments are similar in many respects to the panic handles disclosed in my earlier U.S. Pat. No. 4,711,480 issued Dec. 8, 1987; U.S. Pat. No. 4,506,922 issued Mar. 26, 1985; U.S. Pat. No. 4,418,949 issued Dec. 6, 1983; U.S. Pat. No. 4,382,620 issued May 10, 1983 and U.S. Pat. No. 4,366,974 issued Jan. 4, 1983. For the sake of brevity, the following description will focus only on the specific features of the present panic handles that are different from that disclosed in my prior panic handle patents listed above. The complete disclosures of my earlier U.S. Patents can be referred to for a detailed description of the remaining features that are not discussed in detail herein. For ease of reference, FIGS. 1–5 from my earlier U.S. Pat. No. 4,366,974 are reproduced in their entirety in FIGS. 1–5.

Figure 2:
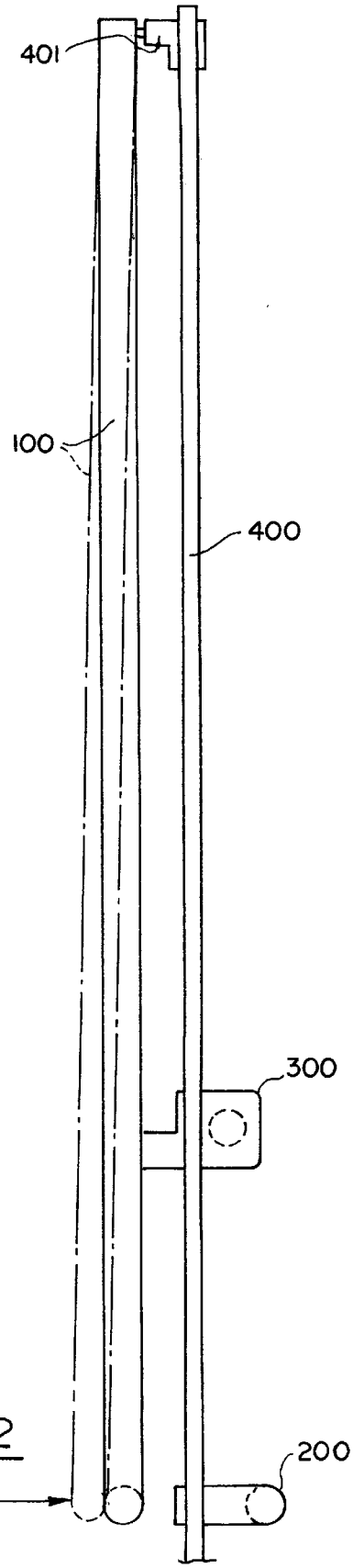
FIG. 2 (PRIOR ART)
FIG. 2 is a side view of the panic handle of FIG. 1 illustrating the relative motion of the panic handle in its outer (latched) position and inner (unlatched) position.
Figure 4:
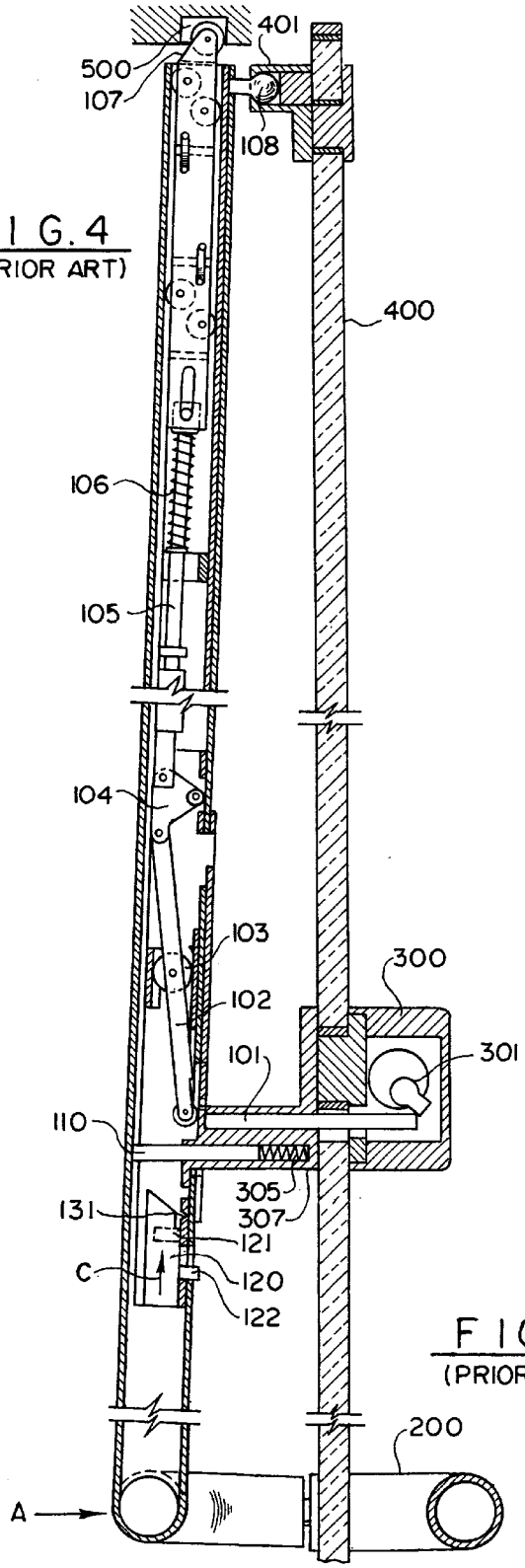
FIG. 4 (PRIOR ART)
FIG. 4 is a view like FIG. 3, but shown in the unlatched position.
Figure 3:
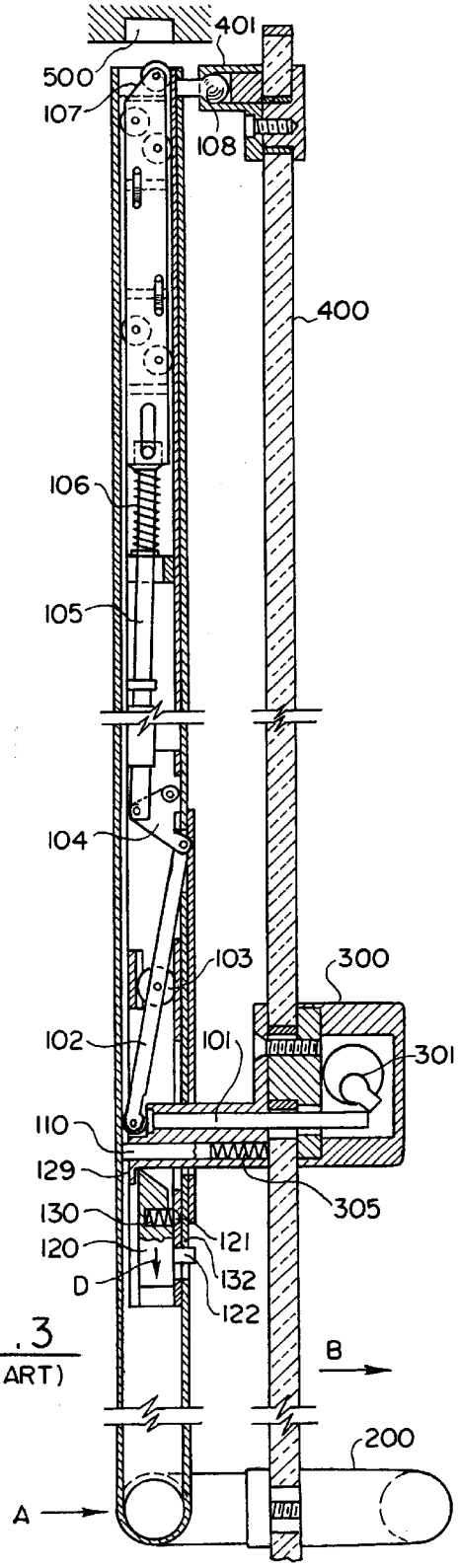
FIG. 3 (PRIOR ART)
FIG. 3 is a vertical sectional view taken along the lines III—III of FIG. 1, with the door and panic handle mechanism shown in the latched position.
Figure 5:
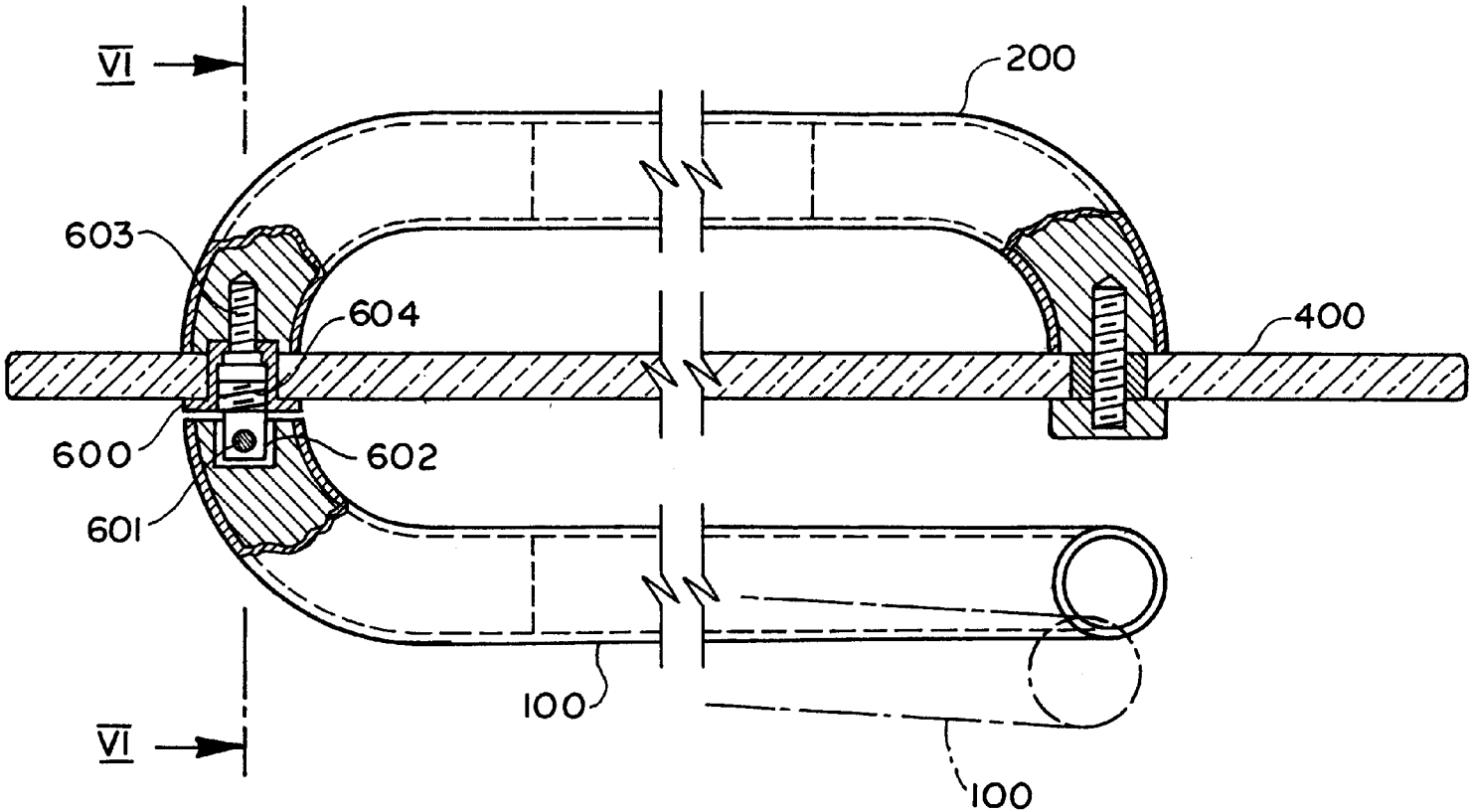
FIG. 5 (PRIOR ART)
FIG. 5 is a transverse sectional view of the panic handle of FIG. 1, taken along the lines V—V of FIG. 1.

In FIGS. 6–9 is illustrated a panic handle in accordance with a first embodiment of the present invention and mounted to a door 100. As should be understood, the composition of the door 100 can comprise any of a number of different types of doors and made from various materials, such as wood, metal or glass, to name a few. In this embodiment, the door 100 is comprised of glass. The panic handle of the present embodiment as illustrated in FIGS. 2 and 3 comprises a handle assembly 12. The components of the handle assembly 12 of the present embodiment include an interior door handle 14 and a slide assembly. In this embodiment, the slide assembly comprises at least one slide member 18 and at least one link 20. The handle assembly 12 of the present embodiment also preferably comprises an exterior door handle 16 and means for attaching the interior and exterior door handles 14 and 16 to the door 100, which in this embodiment comprises at least one interior spacer 22, at least one exterior spacer 24, at least one bushing 26 and at least one fastener 28. The panic handle of the present embodiment also preferably includes at least one end cap 31. In the illustrated embodiment, there are provided two slides 18, two links 20, two interior spacers 22, two exterior spacers 24, two bushings 26, two fasteners 28 and four end caps 31, and with each end cap 31 at terminating ends of the interior and exterior handle members 14 and 16, respectively. The various components of the panic handle of the present embodiment will be described in more detail below.

The interior door handle 14 in this embodiment is a substantially hollow member and generally "L" shaped in configuration defining a horizontal component 14*a* and a vertical component 14*b*. In other embodiments, the interior door handle 14 can be of other configurations as well, such as straight, and adapted to be mounted to a door in a variety of different orientations, such as having any number of vertical and/or horizontal components as well as having any number of components of various angular positions. In addition, in the present embodiment, the interior door handle 14 incorporates both the slide assembly and latching assembly together in a single structure. In other embodiments, the slide assembly and latching assembly can be provided in separate structures where desired.

Figure 6:
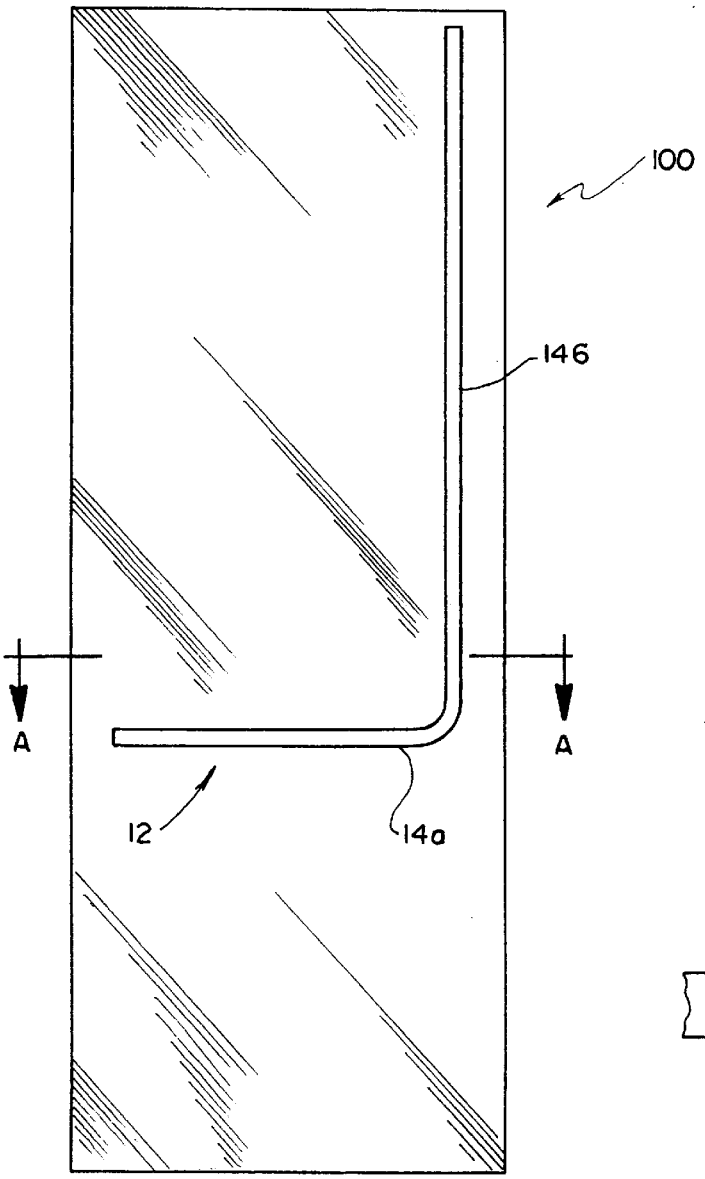
FIG. 6 is a front elevational view of an embodiment of a panic handle in accordance with the present invention and illustrated mounted to a door.
Figure 9:
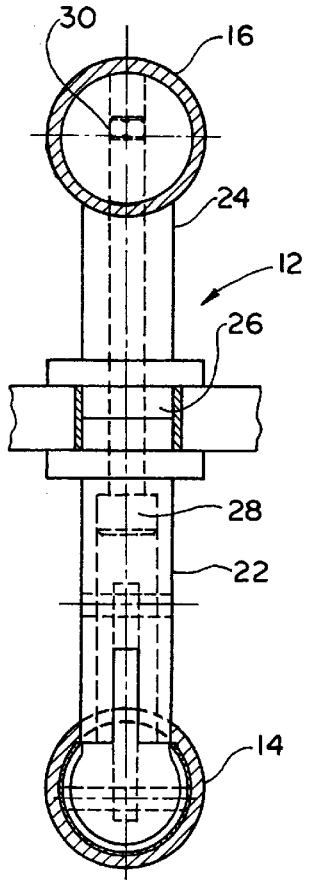
FIG. 9 is a sectional side elevational view of the handle assembly of FIG. 6 taken along the line 9—9 of FIG. 8.
Figures 7, 8:
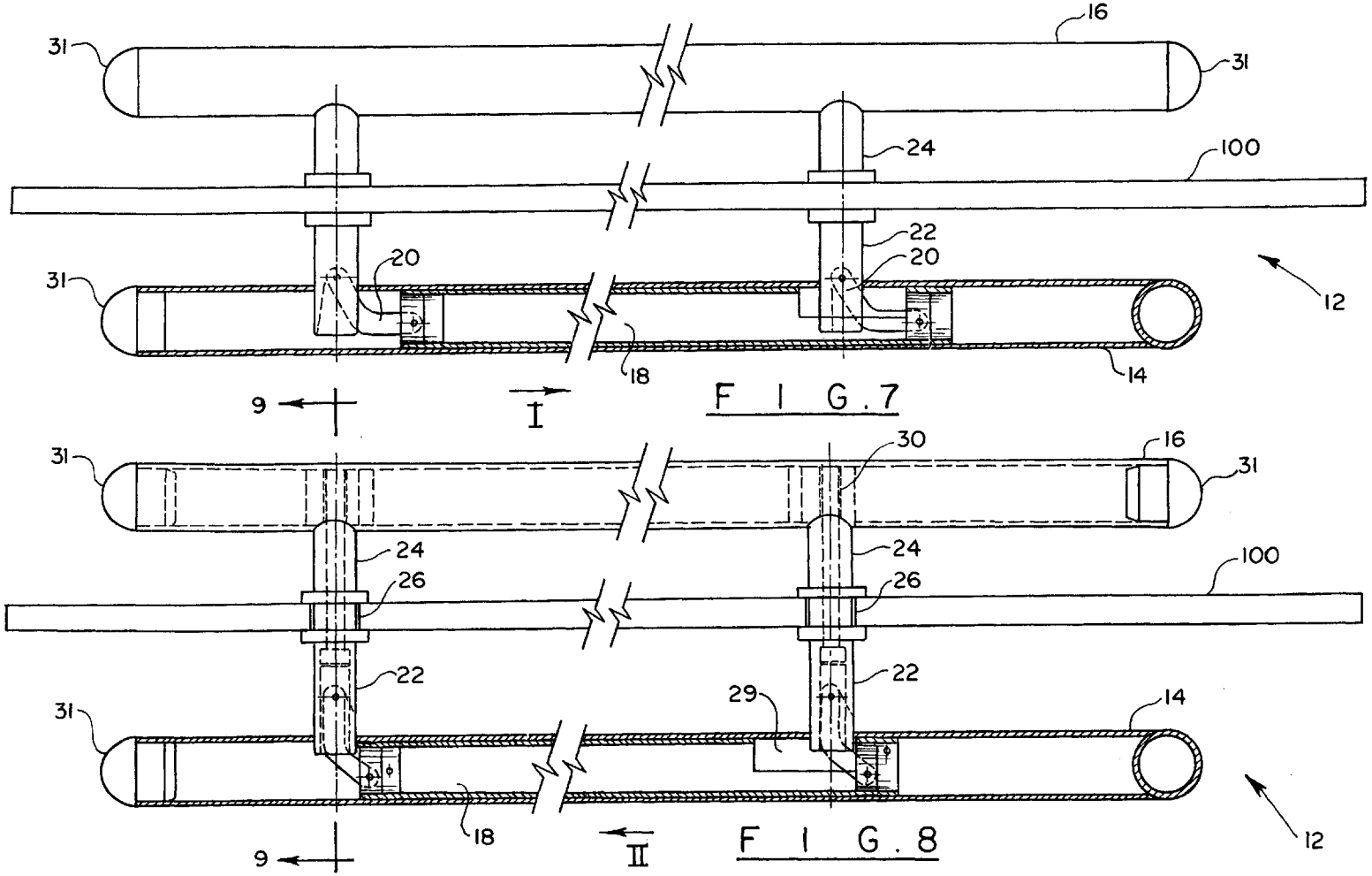
FIG. 7 is a sectional top plan view of one embodiment of a handle assembly of FIG. 6 taken along the line A—A and with the handle assembly shown in an inward position.
FIG. 8 is a top plan view of the handle assembly of FIG. 7 shown in an outward position.
Figure 10:
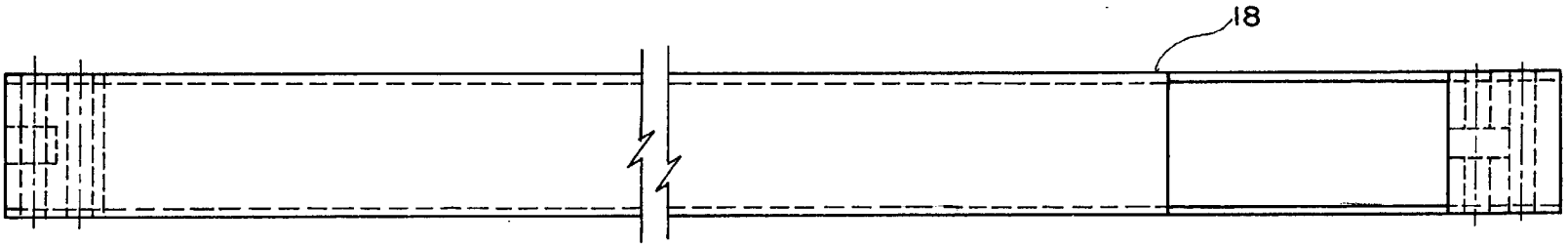
FIG. 10 is an isolated top plan view of a slide of the handle assembly of FIG. 6.
Figure 11:
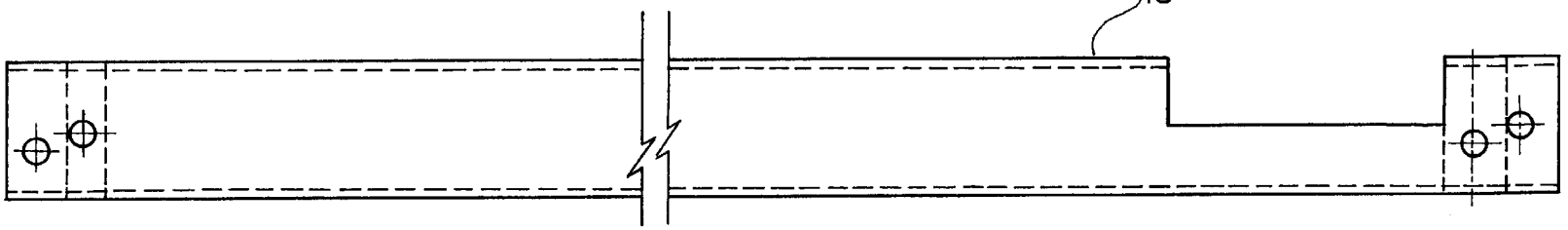
FIG. 11 is a front view of the slide of FIG. 10.
Figures 12, 13:
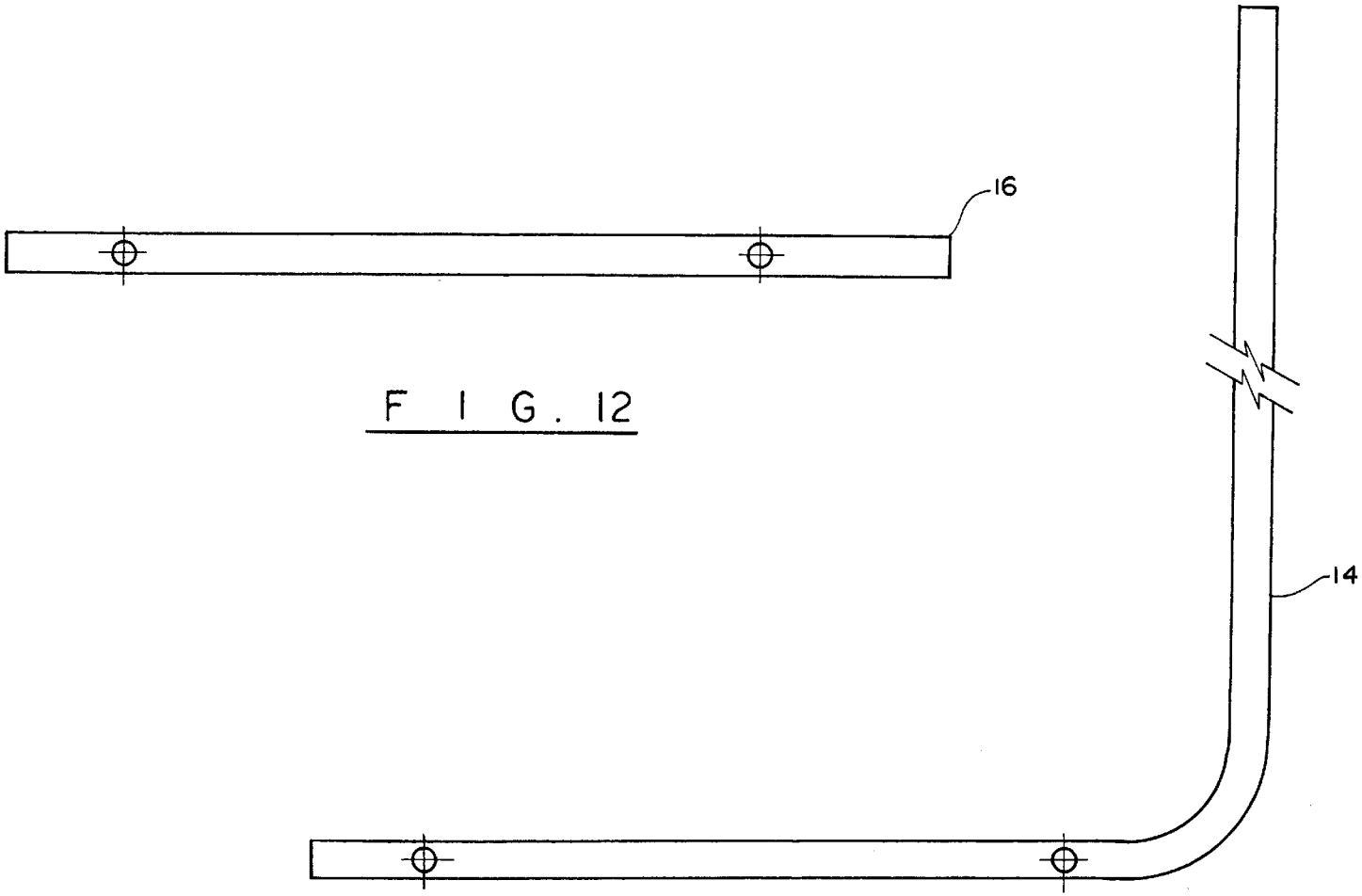
FIG. 12 is an isolated front view of an exterior handle member of the handle assembly of FIG. 7.
FIG. 13 is an isolated front view of an interior handle member of the handle assembly of FIG. 7.
Figure 14A:
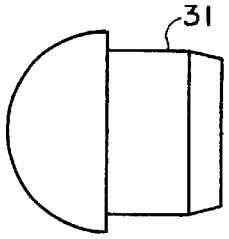
FIG. 14*a* is an isolated front elevational view of an end cap of the handle assembly of FIG. 7.
Figure 14B:
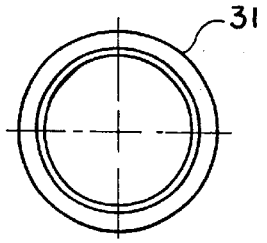
FIG. 14*b* is a right side elevational view of the end cap of FIG. 14*a*.
Figure 15A:
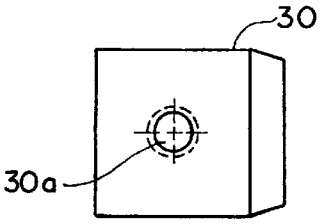
FIG. 15*a* is an isolated front elevational view of an exterior connector of the handle assembly of FIG. 7.
Figure 15B:
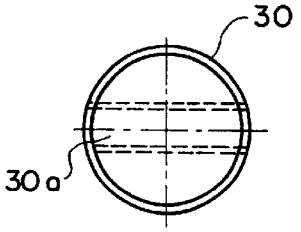
FIG. 15*b* is a right side elevational view of the exterior conector of FIG. 15*a*.
Figure 16A:
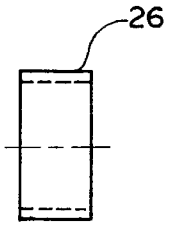
FIG. 16*a* is an isolated front elevational view of a bushing of the handle assembly of FIG. 7.
Figure 16B:
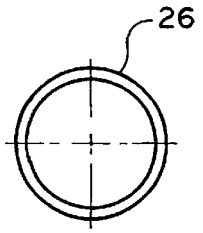
FIG. 16*b* is a right side elevational view of the bushing of FIG. 16*a*.
Figure 17A:
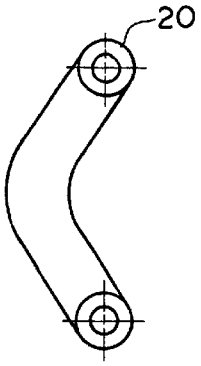
FIG. 17*a* is an isolated front elevational view of a link of the handle assembly of FIG. 7.
Figure 17B:
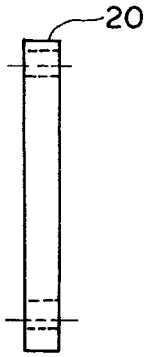
FIG. 17*b* is a right side elevational view of the link of FIG. 17*a*.

In operation, the horizontal component 14*a* of the interior door handle 14 is moved along a line substantially perpendicular the surface of door 100 between inward and outward positions shown in FIGS. 6 and 7, respectively. In this embodiment, the movement of the horizontal component 14*a* of the interior door handle 14 is provided by the relationship between the interior door handle 14, slide 18, the link 20 and interior spacer 22. In operation, the movement of the interior door handle 14 coincides with lateral movement of the slide 18 in a direction substantially parallel the door surface. As illustrated in FIGS. 7 and 8, movement of the interior door handle 14 from its outward to its inward position corresponds with lateral movement of the slide 18 in the direction of arrow I. Similarly, movement of the interior door handle 14 from its inward to its outward position results with lateral movement of the slide 18 in the direction opposite that of arrow I, which is shown by arrow II. As will be described herein, an advantage of the handle assembly 12 is that the interior door handle 14 can be depressed and moved between its outward and inward positions through application of force by an operator anywhere along the length of the interior door handle 14. In the present embodiment, preferably two each of links 20 and interior spacers 22 are provided, and at spaced separation, however, it should be understood that any number of these components and at various spacing can be provided for this same purpose. In the present embodiment, the slide 18 is a substantially tubular member and positioned within the cavity extending through the horizontal component 14*a* of the interior door handle 14. Each link 20 is a generally "U" shaped member connected at one end to the slide 18 and connected to one interior spacer 22 at the second end. In this embodiment, preferably the slide 18 also includes a window 29 generally rectangular in configuration to allow additional clearance for the link 20 as the slide 18 is moved between its inward and outward positions. Each interior spacer 22 in turn is secured to the door 100. In the present embodiment, the two bushings 26 are inserted in adjacent openings in the door 100 and the interior and exterior spacers 22 and 24 are placed into the opposite ends of each bushing 26. The two fasteners 28, comprising a hex screw/nut combination in this embodiment, extend through openings provided longitudinally through the interior and exterior spacers 22 and 24 and extend into a connector 30 positioned in the exterior handle member 16. As shown in FIGS. 15*a*–15*b*, the connector 30 is a generally cylindrical member and includes an opening 30*a* extending therethrough transverse its longitudinal axis into which the fastening member 28 is received. Preferably, the connector 30 is assembled by being press-fit in the opening extending through the exterior handle member 14. As illustrated in FIGS. 16*a* and 16*b*, each bushing is also generally cylindrical in configuration and is preferably comprised of a conventional sealing material, such as an elastomer. As illustrated in FIGS. 18*a*–18*b*, each interior spacer is an elongate member defining a channel 59 in a first end, two spaced bosses 61 at a second end, a flange 63 proximate the second end and an opening extending longitudinally through the spacer 22. As illustrated in FIGS. 14*a*–14*c*, each exterior spacer 24 defines an elongate member comprising two spaced bosses 65 proximate a first end, a concave depression at a second end 67, a flange 69 proximate the first end and an opening extending longitudinally through the spacer 24. On assembly, the bosses 61 and 65 of the spacers 22 and 24, respectively, are positioned within the bushing 26 located in the door opening and connected to prevent relative rotation of these elements in operation. The flanges 63 and 69 of the spacers 22 and 24, respectively, are positioned against opposing surfaces of the door 100. The fasteners 28 are received through the openings in the spacers 22 and 24 and then secured to the connector 30 positioned in the exterior handle member 16, as shown in FIG. 9. The structure and operation of the latching assembly of the panic handle of the present embodiment is the same as that set out in my '974 patent and will not be further described herein for this reason. The panic handle of the present embodiment can be made from any suitable material, such as metal, and by any suitable manufacturing process.

Figure 20:
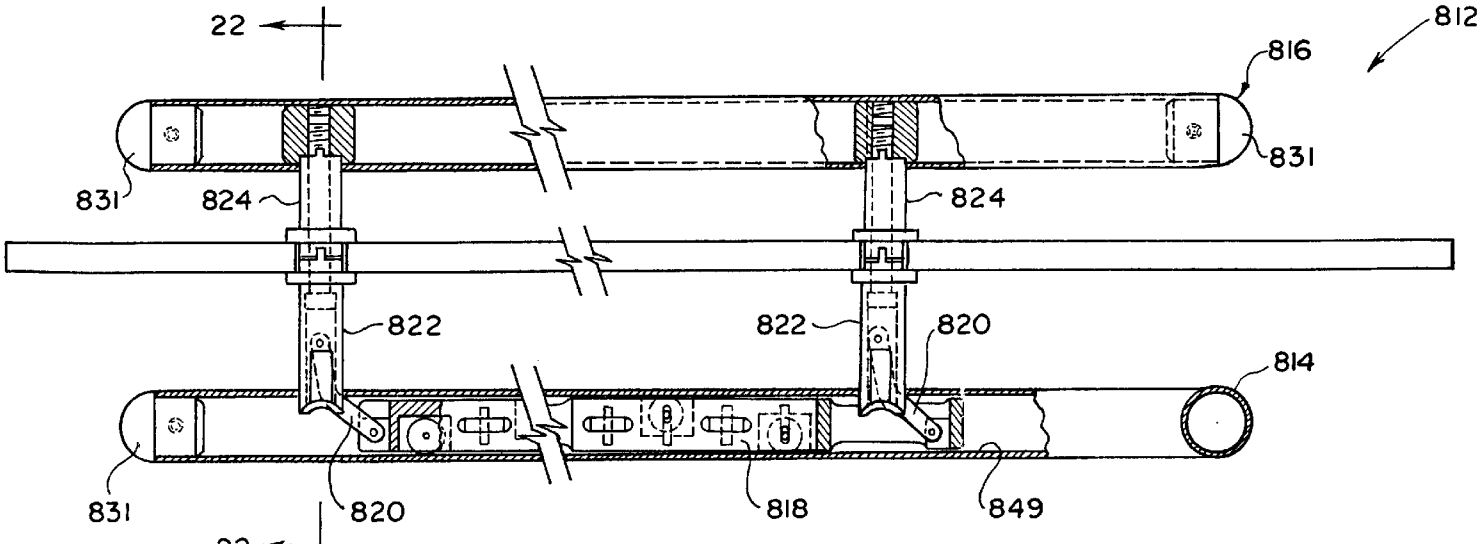
FIG. 20 is a sectional top plan view of a preferred embodiment of a handle assembly of FIG. 6 taken along the line A—A and with the handle assembly shown in an outward position.
Figure 21:
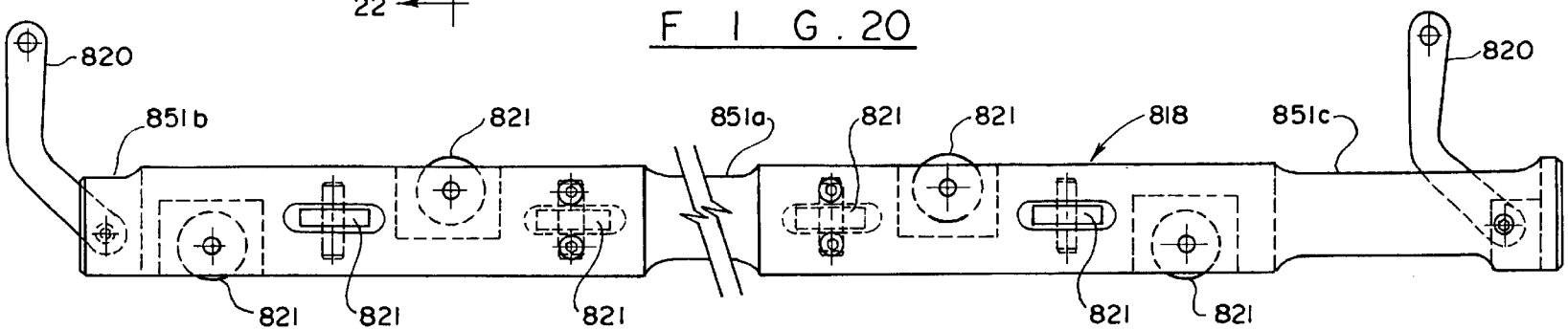
FIG. 21 is an isolated top plan view of a slide and links of FIG. 20.
Figure 23A:
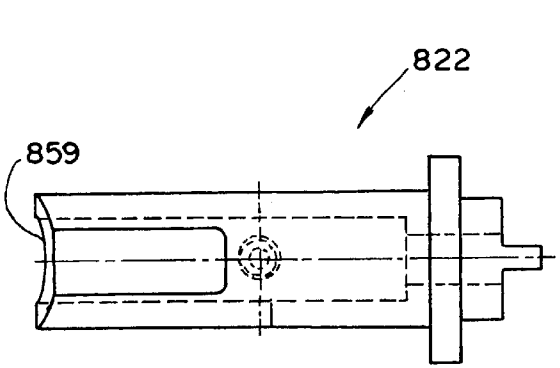
FIG. 23*a* is an isolated front elevational view of an interior spacer of the handle assembly of FIG. 20.
Figure 23D:
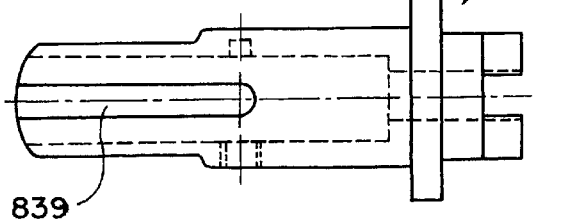
FIG. 23*d* is a top plan elevational view of the interior spacer of FIG. 23*a*.
Figure 23B:
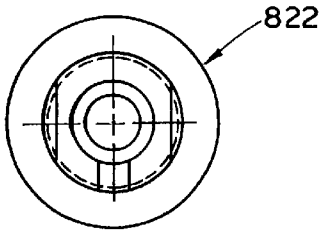
FIG. 23*b* is a left side elevational view of the interior spacer of FIG. 23*a*.
Figure 23C:
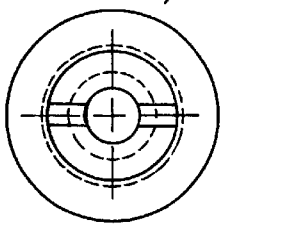
FIG. 23*c* is a right side elevational view of the interior spacer of FIG. 23*a*.
Figure 22:
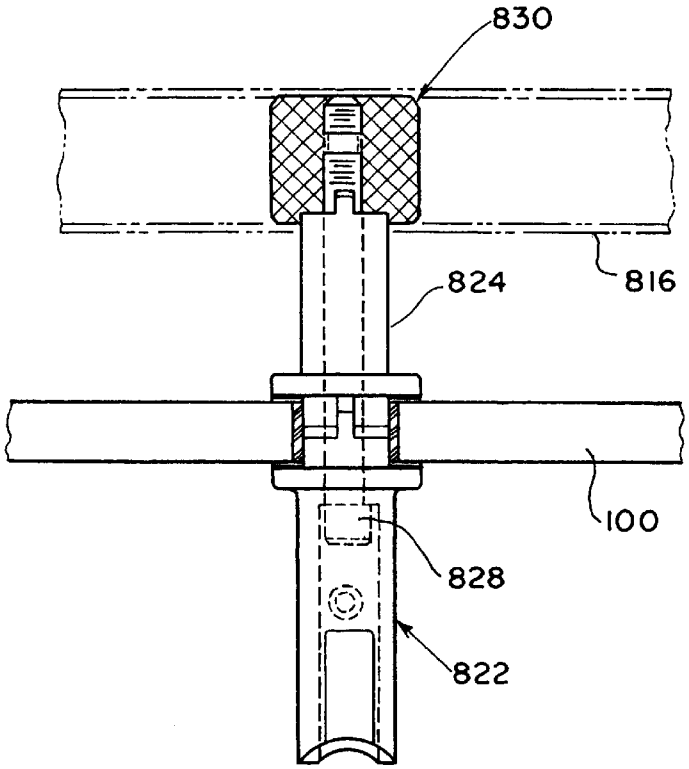
FIG. 22 is a sectional side elevational view of the handle assembly of FIG. 20 taken along the line 22—22 of FIG. 20.

In FIGS. 20–26 is illustrated a panic handle in accordance with a preferred embodiment of the present invention. For the sake of brevity, only the portions of the present panic handle that differ from the panic handle of the first embodiment will be described. As illustrated in FIG. 20, the difference of the present panic handle is the handle assembly 812; in particular, the handle assembly 812 as compared to the handle assembly 12 includes a variation in the structure of the slide 818, link 820, interior spacer 822, exterior spacer 824 and connector 830. As shown in FIGS. 20 and 21, the slide 818 in this embodiment includes at least one and preferably eight wheels 821 secured longitudinally along its surface, which facilitate the sliding movement of the slide 818 within the interior door handle 814; in particular, the wheels 821 come into contact with the inner surface 849 of the interior door handle 814. For this purpose, in this embodiment, the slide 818 preferably includes a channel into which each wheel 821 is received and each wheel 821 is then secured by any suitable means, such as a pin member, to the slide 818. In addition, in the present embodiment, the eight wheels 821 are preferably grouped into two sets of four, and with each wheel in a set of four being positioned at approximately 90 degree intervals. Further, in this embodiment, the slide 818 includes at least one section of reduced diameter along its longitudinal axis for added clearance relative to the inner surface 849 of the interior door handle 14. The added clearance of the slide 818 can be beneficial in operation due to the load placed upon it; in particular, the load on slide 818 can result with some bending due to the connection of the slide 818 with the links 820 proximate its opposing ends. In this embodiment, the slide 818 preferably includes a reduced diameter portion 851*a* between its terminating ends as well as reduced diameter portions 851*b* and 851*c* proximate each terminating end.

Figure 24A:
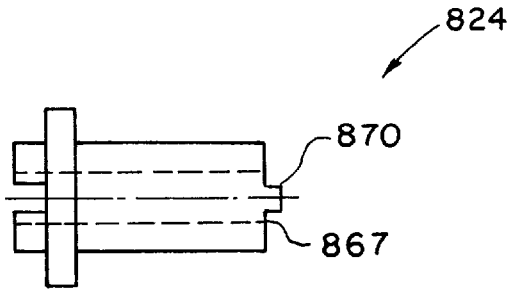
FIG. 24*a* is an isolated front elevational view of an exterior spacer of the handle assembly of FIG. 20.
Figure 24B:
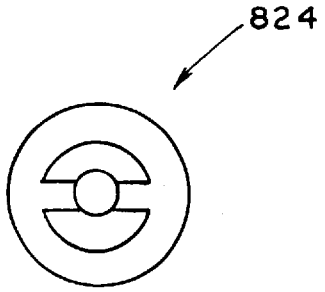
FIG. 24*b* is a right side elevational view of the exterior spacer of FIG. 24*a*.
Figure 25A:
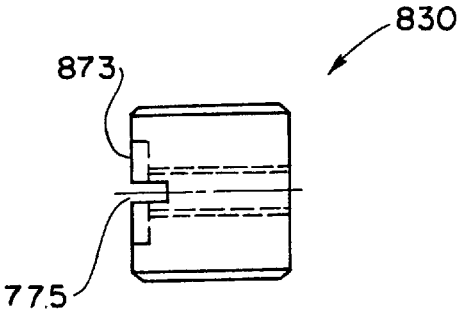
FIG. 25*a* is an isolated front elevational view of an exterior handle member door connector of the handle assembly of FIG. 20.
Figure 25B:
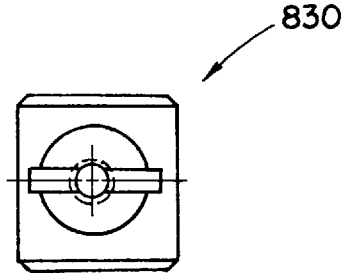
FIG. 25*b* is a top plan view of the exterior handle member door connector of FIG. 25*a*.
Figure 26A:
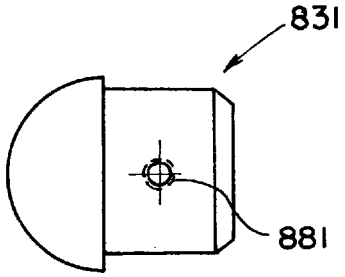
FIG. 26*a* is an isolated front elevational view of an end cap of the handle assembly of FIG. 20.
Figure 26B:
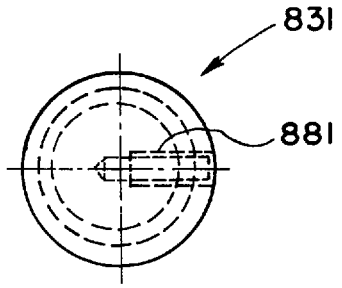
FIG. 26*b* is a right side elevational view of the end cap of FIG. 26*a*.

As illustrated in FIGS. 20 and 23*a*–23*d*, the interior spacers 822 include a slightly longer channel 839 along the longitudinal axis than the channel 59 in the interior spacers 22, which operates as additional assurance that the position of the links 820 will be maintained in the channels 839 in operation. In the present embodiment, the longer length of the channels 839 is provided by a concave depression in the first end 859 of the spacer 822 rather than being substantially planer as with the spacer 22. Further, the links 820 are preferably slightly longer in length in order to maintain the slide 818 substantially parallel when force is applied to it. Further, as shown in FIGS. 24*a*–24*b*, the exterior spacers 824 include a boss 870 at its second end 867 rather than having a concave depression as present in the exterior spacer 24. The structure of the connector 830 in the exterior handle member 816, in turn, is changed to accommodate the exterior spacer 824, as shown in FIGS. 25*a*–25*b*. In this embodiment, the connector 830 is provided with an annular depression 873 and a central bore 875 to receive the second end 867 and boss 870 of the exterior spacer 824 on assembly. Finally, as shown in FIGS. 26*a* and 26*b*, the end caps 831 include an opening 881 therethrough to receive a fastening member, such as a pin, to secure the connection of the end caps 831 to the ends of the interior and exterior handle members 814 and 816.

In view of that set forth above, it should be understood that there are certain benefits and advantages disclosed that are attributed to the present invention. One advantage is that the present invention discloses a novel handle assembly that has broad application and can be used for a variety of purposes. Two embodiments of the handle assembly are illustrated in the present invention. One specific application for use of the handle assembly of the present invention is a panic handle device. The present application discloses the two embodiments of the handle assembly incorporated into panic handle devices of a type similar to my earlier patents, however, it should be understood that the handle assemblies disclosed can be utilized in other types of panic handles as well.

Another advantage of the present invention is that a panic handle is provided in which the operating mechanism is provided within the handle itself, the handle is spaced from the door and the panic device can be actuated by depressing anywhere along the length of the handle.

Still another advantage of the present invention is that a panic handle can be provided of different configurations and capable of being mounted to a door in different positions where desired. For example, a panic handle can be provided comprising a straight bar rather than an "L" shaped bar as disclosed. Other configurations, while not disclosed, are also possible. In addition, continuing with this example, the straight panic bar can then be mounted in any position on the door, such as horizontal, vertical or at any desired angle.

Accordingly, it should be understood that the description of the present invention is susceptible to considerable modifications, changes and adaptation by those skilled in the art, and that such modifications, changes and adaptations are intended to be considered within the scope of the present invention as defined by the appended claims.

I claim:

1. A panic handle adapted for mounting on a door having inner and outer surfaces and comprising:

a latch assembly; and a handle assembly for operating the latch assembly, handle assembly including a cavity therein substantially receiving said latch assembly, the handle assembly further defining a handle, the entire length of said handle spaced substantially parallel a predetermined distance from the door, the entire length of said handle movable in a direction substantially perpendicular to the surface of the door between an outward position spaced from the door and an inward position closer to the door than the outward position, the distance of each end of said handle being an equal distance from said door in all positions, and with the handle further including an opening therein and means substantially within the opening of the handle for translating the handle between the extended and retracted positions, wherein said means substantially within the opening of the handle for translating the handle between the extended and retracted positions comprises a generally elongated slide positioned in said opening of said handle for lateral movement and at least one link member connected proximate a first end to said slide and connected proximate a second end to at least one attachment member, and with said at least one attachment member being adapted to be secured to said door, wherein said slide is moved laterally in a first direction as the handle is moved from the extended position to the retracted position and said slide is moved laterally in a second direction opposite the first direction as the handle is moved from the retracted position to the extended position, and wherein said slide includes at least one wheel for contacting an inner surface of the handle defined by the opening therein as the slide is moved laterally corresponding with movement of the handle.

2. A panic handle of claim 1, wherein said at least one attachment member comprises an interior spacer having a channel in a first end and with said channel extending a predetermined distance in a direction of a second end, and with said link positioned in said channel as said slide is moved laterally corresponding with movements of said handle.

3. The panic handle of claim 2, wherein said slide defines a substantially constant diameter along a longitudinal direction and at least one section of reduced diameter, and with said substantially constant diameter being greater than said reduced diameter.

4. The panic handle of claim 3, wherein said at least one reduced diameter section is proximate a center between terminating ends of said slide.

5. The panic handle of claim 4, wherein said slide includes a reduced diameter section proximate each terminating end.

6. The panic handle of claim 5, wherein said handle assembly further includes an exterior handle, an exterior spacer and means for connecting said interior spacer, said exterior spacer and said exterior handle.

7. The panic handle of claim 6, wherein said handle further includes two links, two interior spacers and two exterior spacers.

8. The panic handle of claim 7, wherein said slide includes at least two wheels positioned on said slide and spaced at approximately a 90 degree interval.

9. The panic handle of claim 8, wherein each said interior spacer includes a first end, a pair of bosses at a second end, a flange proximate said second end and an opening extending longitudinally therethrough, and wherein each said exterior spacer includes a pair of bosses at a first end, a flange proximate said first end and an opening extending longitudinally therethrough, whereby said bosses of said interior spacer engage said exterior spacer, said bosses of said exterior spacer engage said interior spacer, said flanges of said interior spacer and said exterior spacer are adapted to engage said inner and outer surfaces of said door and said means for connecting said interior spacer, said exterior spacer and said exterior handle comprises a fastening member extending through said openings longitudinally through said interior spacer and said exterior spacer.

10. The panic handle of claim 9, wherein each said exterior spacer further comprises a boss at a second end and said exterior handle member comprises a substantially annular depression and a central bore for receiving said second end and said boss of said exterior spacer.

11. The panic handle of claim 10, wherein said slide includes eight wheels arranged in two groups of four wheels, and with each wheel in a group of four wheels being spaced at approximately 90 degree intervals.

12. A handle assembly adapted for a panic handle having a latching mechanism operable by said handle assembly, said handle assembly comprising:

a handle moveable between extended and retracted positions, the entire length of said handle spaced substantially parallel a predetermined distance from the door, and with said handle defining an elongate member having an opening longitudinally therein, a generally elongated slide positioned in said opening of said handle for lateral movement corresponding with movement of said handle between said extended and retracted positions, the distance of each end of said handle being an equal distance from said door in all positions, and at least one link member connected to said slide proximate a first end of said link located within said opening of said handle and connected to at least one attachment member proximate a second end of said link, wherein said slide is moved laterally in a first direction as the handle is moved from the extended position to the retracted position and said slide is moved laterally in a second direction opposite the first direction as the handle is moved from the retracted position to the extended position, wherein said slide includes at least one wheel for contacting an inner surface of the handle defined by the opening longitudinally therein as the slide is moved laterally corresponding with movement of the handle.

13. The handle assembly of claim 12, wherein said at least one attachment member comprises an interior spacer having a channel in a first end and with said channel extending a predetermined distance in a direction of a second end, and with said link positioned in said channel as said slide is moved laterally corresponding with movements of said handle.

14. The handle assembly of claim 13, wherein said slide defines a substantially constant diameter along a longitudinal direction and at least one section of reduced diameter, and with said substantially constant diameter being greater than said reduced diameter.

15. The handle assembly of claim 14, wherein said at least one reduced diameter section is proximate a center between terminating ends of said slide.

16. The handle assembly of claim 15, wherein said slide includes a reduced diameter section proximate each terminating end.

17. The handle assembly of claim 16, wherein said handle assembly further includes an exterior handle, an exterior spacer and means for connecting said interior spacer, said exterior spacer and said exterior handle.

18. The handle assembly of claim 17, wherein said handle further includes two links, two interior spacers and two exterior spacers.

19. The handle assembly of claim 18, wherein said slide includes at least two wheels positioned on said slide and spaced at approximately a 90 degree interval.

20. The handle assembly of claim 19, wherein each said interior spacer includes a first end, a pair of bosses at a second end, a flange proximate said second end and an opening extending longitudinally therethrough, and wherein each said exterior spacer includes a pair of bosses at a first end, a flange proximate said first end and an opening extending longitudinally therethrough, whereby said bosses of said interior spacer engage said exterior spacer, said bosses of said exterior spacer engage said interior spacer, said flanges of said interior spacer and said exterior spacer are adapted to engage inner and outer surfaces of a door and said means for connecting said interior spacer, said exterior spacer and said exterior handle comprises a fastening member extending through said openings longitudinally through said interior spacer and said exterior spacer.

21. The handle assembly of claim 20, wherein each said exterior spacer further comprises a boss at a second end and said exterior handle member comprises a substantially annular depression and a central bore for receiving said second end and said boss of said exterior spacer.

22. The handle assembly of claim 21, wherein said slide includes eight wheels arranged in two groups of four wheels, and with each wheel in a group of four wheels being spaced at approximately 90 degree intervals.

* * * * *

UNITED STATES PATENT AND TRADEMARK OFFICE

CERTIFICATE OF CORRECTION

PATENT NO. : 6,726,257 B2
DATED : April 27, 2004
INVENTOR(S) : William J. Horgan, Jr.

It is certified that error appears in the above-identified patent and that said Letters Patent is hereby corrected as shown below:

Column 8,
Line 1, replace "5", with -- 4 --

Signed and Sealed this

Thirteenth Day of July, 2004

JON W. DUDAS
*Acting Director of the United States Patent and Trademark Office*